US011172554B2

(12) United States Patent
Deng et al.

(10) Patent No.: US 11,172,554 B2
(45) Date of Patent: Nov. 9, 2021

(54) SERIES RESONANT CONVERTER, PRIMARY FEEDBACK CONTROL CIRCUIT AND CONTROL METHOD THEREOF

(71) Applicant: Silergy Semiconductor Technology (Hangzhou) LTD, Hangzhou (CN)

(72) Inventors: Jian Deng, Hangzhou (CN); Chen Zhao, Hangzhou (CN)

(73) Assignee: Silergy Semiconductor Technology (Hangzhou) LTD, Hangzhou (CN)

( * ) Notice: Subject to any disclaimer, the term of this patent is extended or adjusted under 35 U.S.C. 154(b) by 0 days.

(21) Appl. No.: 16/752,920

(22) Filed: Jan. 27, 2020

(65) Prior Publication Data

US 2020/0267812 A1 Aug. 20, 2020

(30) Foreign Application Priority Data

Feb. 15, 2019 (CN) ..... 201910122675.6

(51) Int. Cl.
*H05B 45/14* (2020.01)
*H05B 45/37* (2020.01)

(52) U.S. Cl.
CPC ..... *H05B 45/14* (2020.01); *H05B 45/37* (2020.01)

(58) Field of Classification Search
CPC ..... H05B 33/0815; H05B 33/0845; H05B 33/0851; H05B 33/0866; H05B 33/0887; H05B 45/14; H05B 45/24; H05B 45/37; H05B 45/39; H05B 45/375; H05B 45/382; H02M 1/083; H02M 3/33569
USPC ..... 315/274, 307
See application file for complete search history.

(56) References Cited

U.S. PATENT DOCUMENTS 5,424,933 A * 6/1995 Illingworth ..... H02M 3/33546 363/21.02
6,005,780 A 12/1999 Hua
6,580,258 B2 6/2003 Wilcox et al.
9,325,254 B2 4/2016 Deng et al.
9,331,588 B2 5/2016 Chen
9,488,680 B2 11/2016 Xu
10,008,946 B1 * 6/2018 Yang ..... H05B 45/37
2009/0251925 A1 * 10/2009 Usui ..... H02M 3/33576 363/16
2010/0295471 A1 * 11/2010 Ishikura ..... H05B 45/35 315/294
2012/0113689 A1 * 5/2012 Chen ..... H02M 3/33523 363/21.17
2012/0153866 A1 * 6/2012 Liu ..... H05B 45/3725 315/294
2012/0262082 A1 * 10/2012 Esaki ..... H05B 45/14 315/224
2013/0207558 A1 * 8/2013 Xu ..... H05B 45/10 315/188

(Continued)

*Primary Examiner* — Tung X Le

(57) ABSTRACT

A primary feedback control circuit of a series resonant converter having a transformer, can include: an excitation current simulation circuit configured to sample an excitation voltage of the transformer, and to generate a first voltage representing an excitation current of the transformer; and a feedback control circuit configured to control on and off states of power switches of the series resonant converter in accordance with the first voltage and a second voltage representing a resonant current of the series resonant converter, where the first voltage is controlled to be equal to the second voltage when a secondary current of the transformer is zero.

19 Claims, 6 Drawing Sheets

(56) References Cited

U.S. PATENT DOCUMENTS

| | | | | |
|---|---|---|---|---|
| 2014/0078789 | A1 | 3/2014 | Li et al. | |
| 2014/0239934 | A1 | 8/2014 | Zhang | |
| 2015/0028761 | A1* | 1/2015 | Vonach | H02M 3/33569 315/201 |
| 2015/0160270 | A1 | 6/2015 | Shi et al. | |
| 2015/0195878 | A1* | 7/2015 | Garrity | H05B 45/382 315/186 |
| 2015/0280578 | A1 | 10/2015 | Huang et al. | |
| 2018/0183325 | A1* | 6/2018 | Kuang | H02M 1/4241 |
| 2020/0169176 | A1* | 5/2020 | Murata | H02M 1/00 |

* cited by examiner

SERIES RESONANT CONVERTER, PRIMARY FEEDBACK CONTROL CIRCUIT AND CONTROL METHOD THEREOF

RELATED APPLICATIONS

This application claims the benefit of Chinese Patent Application No. 201910122675.6, filed on Feb. 15, 2019, which is incorporated herein by reference in its entirety.

FIELD OF THE INVENTION

The present invention generally relates to the field of power electronics, and more particularly to series resonant converters, primary feedback control circuits, and associated control methods.

BACKGROUND

A switched-mode power supply (SMPS), or a "switching" power supply, can include a power stage circuit and a control circuit. When there is an input voltage, the control circuit can consider internal parameters and external load changes, and may regulate the on/off times of the switch system in the power stage circuit. Switching power supplies have a wide variety of applications in modern electronics. For example, switching power supplies can be used to drive light-emitting diode (LED) loads.

DETAILED DESCRIPTION

Reference may now be made in detail to particular embodiments of the invention, examples of which are illustrated in the accompanying drawings. While the invention may be described in conjunction with the preferred embodiments, it may be understood that they are not intended to limit the invention to these embodiments. On the contrary, the invention is intended to cover alternatives, modifications and equivalents that may be included within the spirit and scope of the invention as defined by the appended claims. Furthermore, in the following detailed description of the present invention, numerous specific details are set forth in order to provide a thorough understanding of the present invention. However, it may be readily apparent to one skilled in the art that the present invention may be practiced without these specific details. In other instances, well-known methods, procedures, processes, components, structures, and circuits have not been described in detail so as not to unnecessarily obscure aspects of the present invention.

Figure 1:
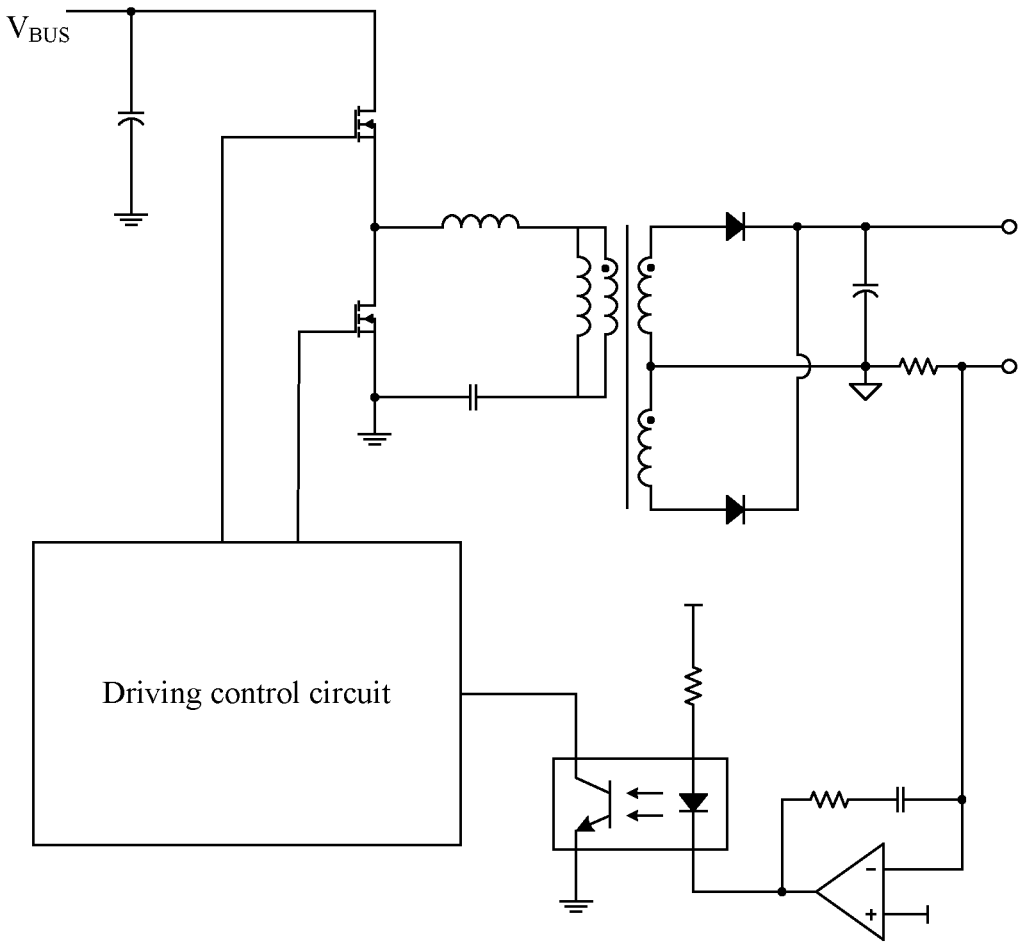
FIG. 1 is a schematic block diagram of an example secondary feedback control circuit of the series resonant converter.

Inductor-inductor-capacitor (LLC) resonant circuits are widely used in light-emitting diode (LED) lighting. However, both an excitation current and a resonant current exist on the primary side of the transformer at the same time because of the complexity of the circuit. Also, an output current of the LLC resonant circuit may not be simply calculated as the flyback circuit does. FIG. 1 shows a schematic block diagram of an example secondary feedback control circuit of the series resonant converter. In this example, a half bridge series resonant converter is taken as an example. Typically, a constant current control can be achieved by adopting a secondary feedback control approach to sample an output current directly to perform the control. With this approach, control signals need to be transmitted by optocouplers to control the on and off states of power switches of the converter. In addition, there are also schemes of the primary feedback control, whereby the primary current is directly treated as the output current under approximate calculation with the excitation current of the transformer being ignored. Therefore, this approach has high precision only when the proportion of the excitation current is quite small, so the circuit works with a frequency above a resonant frequency, and as such may not be universally applied.

In one embodiment, a primary feedback control circuit of a series resonant converter having a transformer, can include: (i) an excitation current simulation circuit configured to sample an excitation voltage of the transformer, and to generate a first voltage representing an excitation current of the transformer; and (ii) a feedback control circuit configured to control on and off states of power switches of the series resonant converter in accordance with the first voltage and a second voltage representing a resonant current of the series resonant converter, where the first voltage is controlled to be equal to the second voltage when a secondary current of the transformer is zero.

Figure 2:
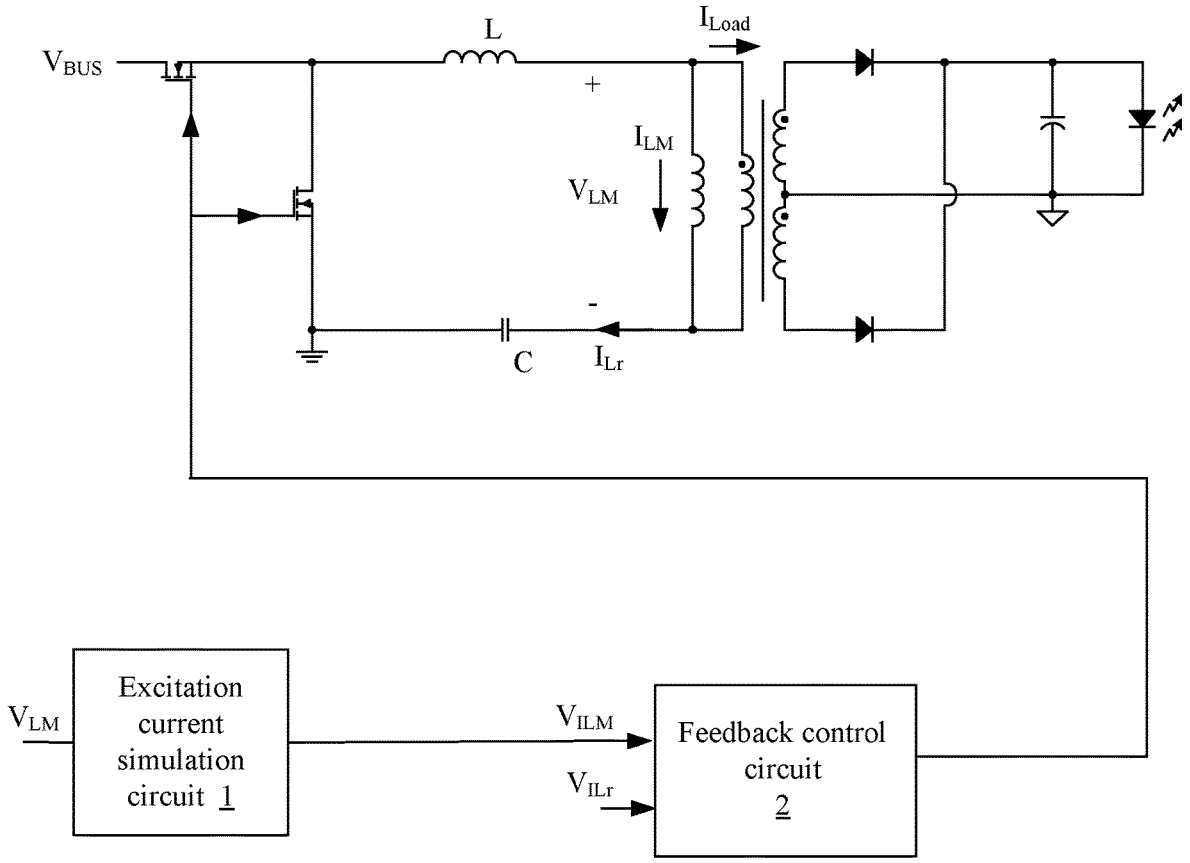
FIG. 2 is a schematic block diagram of an example primary feedback control circuit of the series resonant converter, in accordance with the embodiments of the present invention.

Referring now to FIG. 2, shown is a schematic block diagram of an example primary feedback control circuit of the series resonant converter, in accordance with the embodiments of the present invention. Here, the half bridge series resonant converter is exemplified. The primary feedback control circuit shown in FIG. 2 can include excitation current simulation circuit 1 and feedback control circuit 2. Excitation current simulation circuit 1 may obtain excitation voltage $V_{LM}$, and can generate voltage $V_{ILM}$ representing excitation current km after processing. Also, voltage $V_{ILr}$ representing resonant current $I_{Lr}$ may be sampled at the same time. It should be understood that voltage $V_{ILr}$ can be sampled in any known ways.

Feedback control circuit 2 can receive voltages $V_{ILM}$ and $V_{ILr}$, and can compare a feedback signal, which is obtained in accordance with the difference between voltages $V_{ILM}$ and $V_{ILr}$, against a reference signal representing an expected output current, in order to generate driving signals to control on and off states of power switches to change the switching frequency. In particular embodiments, the output current of the series resonant converter can be exactly calculated in order to achieve an accurate primary feedback control by simulating the information of the excitation current in any frequency range of the series resonant converter.

Figure 3:
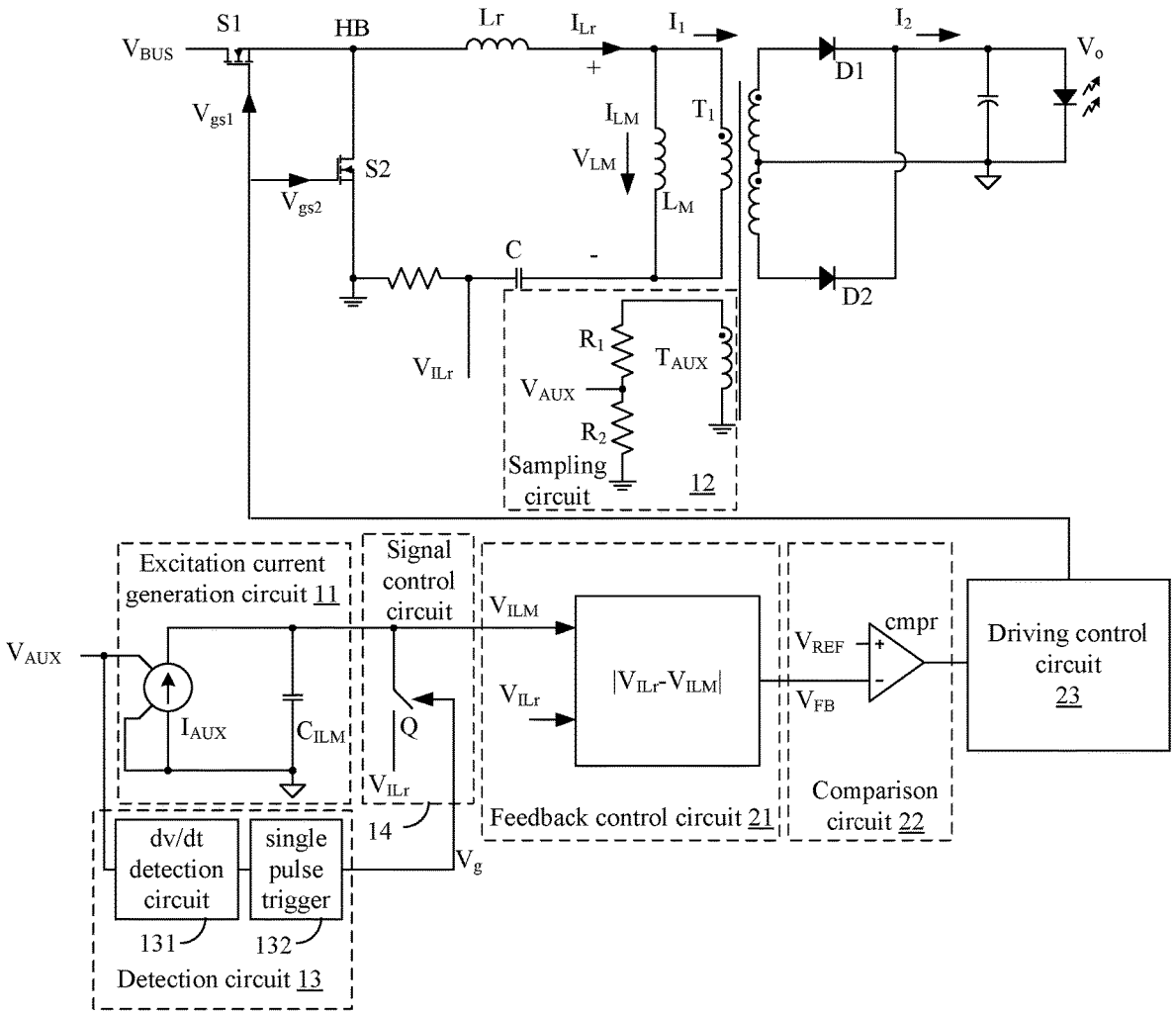
FIG. 3 is a schematic block diagram of a first example primary feedback control circuit of the series resonant converter, in accordance with the embodiments of the present invention.

Referring now to FIG. 3, shown is a schematic block diagram of a first example primary feedback control circuit of the series resonant converter, in accordance with the embodiments of the present invention. Excitation current simulation circuit 1 can include excitation current generation circuit 11, sampling circuit 12, and a detection control circuit. Excitation current generation circuit 11 can receive excitation voltage sampling signal $V_{AUX}$ and converters excitation voltage sampling signal $V_{AUX}$ to current signal $I_{AUX}$ for charging or discharging capacitor $C_{ILM}$, such that voltage $V_{ILM}$ representing excitation current $I_{LM}$ can be obtained. In addition, the detection control circuit can receive excitation voltage sampling signal $V_{AUX}$.

The transformer may not transmit energy to the secondary side from the primary side when resonant current $I_{Lr}$ is equal to excitation current ILM, and thus secondary current $I_2$ may be zero. In that case, resonance can be generated in the transformer due to parasitic capacitors in the circuit, such that excitation voltage $V_{LM}$ varies and does not remain at a high or low level. At that moment, the detection control circuit can detect the change of excitation voltage sampling signal $V_{AUX}$, thereby determining a moment when secondary current $I_2$ reaches zero. Also, voltage $V_{ILM}$ can be controlled to be equal to voltage $V_{ILr}$ when secondary current $I_2$ reaches zero, in order to avoid the accumulation of error.

In particular embodiments, sampling circuit 12 can include auxiliary winding $T_{AUX}$ closely coupled to the secondary windings of the transformer, and resistors $R_1$ and $R_2$ connected in parallel with auxiliary winding $T_{AUX}$. Thus excitation voltage sampling signal $V_{AUX}$ may be sampled according to resistors $R_1$ and $R_2$, and can represent excitation voltage $V_{LM}$ of the transformer. Certainly, it can be also realized by sampling a voltage of the terminals of the primary winding. For example, excitation current generation circuit 11 can include a controlled current source, which may be controlled by excitation voltage sampling signal $V_{AUX}$, and may generate current $I_{AUX}$ according to a preset control coefficient. Capacitor $C_{AUX}$ connected in parallel with the controlled current source can be charged when excitation voltage sampling signal $V_{AUX}$ is positive, and discharged when excitation voltage sampling signal $V_{AUX}$ is negative by current $I_{AUX}$, thereby generating voltage $V_{ILM}$ at the first terminal of capacitor $C_{AUX}$. Here, the shape in which voltage $V_{ILM}$ varies may be consistent with the shape in which excitation current $I_{LM}$ varies. Accordingly, voltage $V_{ILM}$ can represent excitation current $I_{LM}$.

In particular embodiments, the detection control circuit can include detection circuit 13 and signal control circuit 14. Detection circuit 13 can detect excitation voltage sampling signal $V_{AUX}$ to determine the moment when secondary current $I_2$ reaches zero, and may generate an active detection signal $V_g$. Signal control circuit 14 can receive voltages $V_{ILM}$ and $V_{ILr}$, and can be controlled by detection signal $V_g$ to force voltage $V_{ILM}$ to be equal to voltage $V_{ILr}$ at that moment. For example, detection circuit 13 can include dv/dt detection circuit 131 and single pulse trigger 132. When power switch S1 is turned on, resonant inductor Lr may resonate with resonant capacitor C, and secondary diode D1 may be on to provide energy for the load. In that case, the primary voltage of the transformer can be clamped at NVo, where N is the ratio of turns of the primary winding to turns of the secondary winding, and Vo is the output voltage of the resonant converter, so excitation current $I_{LM}$ may rise linearly. In addition, the change rate of excitation voltage sampling signal $V_{AUX}$ can be zero, so detection signal $V_g$ generated by detection circuit 13 may be inactive (e.g., detection signal $V_g$ is at a low level and switch Q is turned off).

When resonant current $I_{Lr}$ resonates to be equal to excitation current ILM, primary current I1 can be zero. In other words, the transformer may not transmit energy to the secondary side and secondary current $I_2$ is zero. Due to the parasitic capacitors in the circuit, a high-frequency resonance can occur in the primary winding of the transformer. At that moment, the dv/dt detection circuit 131 can detect the change of excitation voltage sampling signal $V_{AUX}$ to generate an active signal to single pulse trigger 132. After that, detection signal $V_g$ generated by single pulse trigger 132 may be active with a certain width. In addition, signal control circuit 14 can include switch Q, which may be controlled to be turned on and off by detection signal $V_g$. A first power terminal of switch Q can connect to voltage $V_{ILr}$, and a second power terminal of switch Q can connect to voltage $V_{ILM}$.

When detection signal $V_g$ is active, switch Q can be controlled to be turned on to keep voltage $V_{ILM}$ equal to voltage $V_{ILr}$. In this example, detection signal $V_g$ may be set to be active once in each half resonant cycle. When detection signal $V_g$ is inactive, switch Q can be controlled to be turned off. In this example, the width of detection signal $V_g$ may be relatively short, and then switch Q can be off during the remaining time when secondary current $I_2$ is zero. Because the duration that secondary current $I_2$ is zero may be much shorter as compared with the whole resonant cycle, voltage $V_{ILM}$ can be considered approximately equal to voltage $V_{ILr}$ during this duration.

When secondary current $I_2$ reaches zero, power switch S1 may remain on, so excitation inductor $L_M$ can resonate with resonant inductor Lr and resonant capacitor C. Since this duration is relatively short and excitation inductor $L_M$ may have a relatively large inductance, it can be considered that resonant current $I_{Lr}$ is equal to excitation current $I_{LM}$. Also, current $I_{AUX}$ controlled by excitation voltage sampling signal $V_{AUX}$ can be generated according to the preset control coefficient, and thus may generate voltage $V_{ILM}$ representing excitation current ILM, while voltage $V_{ILr}$ representing resonant current $I_{Lr}$ can be generated by sampling. Therefore, it may not be certain that the conversion coefficient between voltage $V_{ILM}$ and excitation current $I_{LM}$ is matched well with the conversion coefficient between voltage $V_{ILr}$ and resonant current $I_{Lr}$ to ensure that voltage $V_{ILM}$ can be equal to voltage $V_{ILr}$ at a time when secondary current $I_2$ reaches zero. If the two voltages are not equal at that time, error can be accumulated in feedback generation circuit 21 in each resonant cycle, such that the circuit may not be accurately controlled. Thus, detection circuit 13 can determine the moment at which the secondary current reaches zero, such that voltage $V_{LM}$ can be controlled to be equal to voltage $V_{ILr}$, in order to avoid the accumulation of error.

In some implementations, detection circuit 13 may only include dv/dt detection circuit 131. As discussed above, before power switch S1 is turned off, secondary current $I_2$ may be zero and the change rate of excitation voltage $V_{LM}$ can vary because of the high frequency resonance in the circuit. Thus, the output of dv/dt detection circuit 131 may remain at a high level, and then switch Q may remain in the on state, such that voltage $V_{ILM}$ may remain equal to voltage $V_{ILr}$. After power switch S1 is turned off, secondary diode D2 can be turned on to transmit energy to the load, such that the voltage across the primary winding is clamped at −NV0, and excitation current km decreases linearly. Therefore, dv/dt detection circuit 131 can detect that excitation voltage sampling signal $V_{AUX}$ stays the same, thereby generating an inactive signal (e.g., a low level) to control switch Q to be turned off. In other words, detection signal $V_g$ can be active during the resonance of the excitation inductor.

Though there is a moment when the change rate of excitation voltage sampling signal $V_{AUX}$ is zero in the process of high frequency resonance to make detection signal $V_g$ at a low level, it can be substantially ignored because of the extremely short duration. It should be understood that the approaches for controlling voltage $V_{ILM}$ to be equal to voltage $V_{ILr}$ when the secondary current is zero are not limited to the ways in the embodiments above and other circuits that can achieve the same function are supported in particular. For example, the moment at which the secondary current reaches zero can be determined by detecting the value or the change of the frequency of the excitation voltage without detecting the change rate of the excitation voltage.

Feedback control circuit 2 can include feedback generation circuit 21, comparison circuit 22, and driving control circuit 23. In this example, feedback generation circuit 21 can receive voltages $V_{ILM}$ and $V_{ILr}$, and may generate an absolute value of the difference between voltages $V_{ILM}$ and $V_{ILr}$ as feedback signal $V_{FB}$ of the series resonant converter. It should be understood by those skilled in the art that any circuit which can obtain the absolute value of the difference between voltages $V_{ILM}$ and $V_{ILr}$ can be applied in certain embodiments.

Comparison circuit 22 can include comparator cmpr having a non-inverting input terminal for receiving reference signal $V_{REF}$, an inverting input terminal for receiving feedback signal $V_{FB}$, and an output terminal for generating the control signal, which may be provided to driving control circuit 23. Therefore, driving signal $V_{gs1}$ and driving signal $V_{gs2}$ can be generated by driving control circuit 23 to control the on and off states of power switch S1 and power switch S2. It should be understood that the feedback control circuit above is one of the implementation ways of controlling the series resonant converter, and any control circuit which can generate the control signal to control the on and off states of the power switches according to the reference signal and the feedback signal can be applied certain embodiments.

Figure 4:
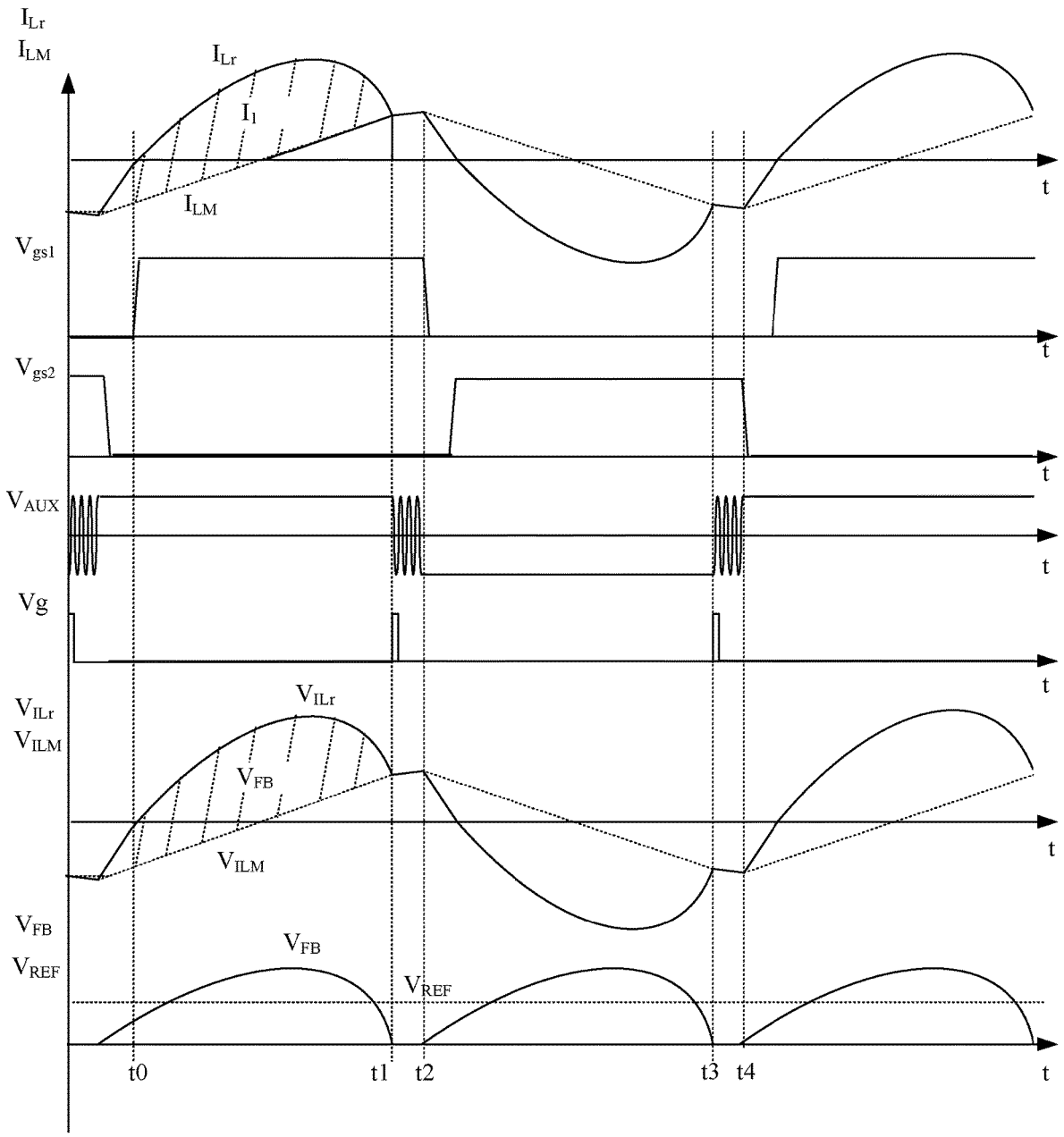
FIG. 4 is a waveform diagram of an example operation of the series resonant converter, in accordance with the embodiments of the present invention.

Referring now to FIG. 4, shown is a waveform diagram of an example series resonant converter in accordance with the embodiments of the present invention. The waveforms of resonant current $I_{Lr}$, excitation current ILM, driving signal $V_{gs1}$, driving signal $V_{gs2}$, excitation voltage sampling signal $V_{AUX}$, detection signal $V_g$, voltage $V_{ILM}$, voltage $V_{ILr}$, feedback signal $V_{FB}$, and reference signal $V_{REF}$ varying with time t are shown in this example. During time t0 to time t1, power switch S1 can be turned on and resonant current $I_{Lr}$ may flow through power switch S1, such that voltage $V_{ILr}$ rises. Secondary diode D1 can be on to provide energy for the load. In addition, the voltage across the primary winding may be clamped at NV0; that is, excitation voltage sampling signal $V_{AUX}$ may remain positive, such that excitation current ILM rises linearly, and voltage $V_{ILM}$ rises linearly. Feedback signal $V_{FB}$, representing the absolute value of the difference between voltages $V_{ILM}$ and $V_{ILr}$ may initially increase, and then decrease, which is consistent with the waveform of feedback signal $V_{FB}$ as shown by the shaded area in FIG. 4.

At time t1, secondary current $I_2$ can reach zero when resonant current $I_{Lr}$ is equal to excitation current $I_{LM}$. In addition, detection circuit 13 can detect that excitation voltage sampling signal $V_{AUX}$ changes suddenly because of the high frequency resonance in the circuit, such that detection signal $V_g$ is generated. Detection signal $V_g$ with an extremely narrow width can control switch Q of signal control circuit 14 to be turned on and then turned off after a period of time, in order to force voltage $V_{LM}$ to be equal to voltage $V_{ILr}$ to avoid the accumulation of error. Though excitation voltage sampling signal $V_{AUX}$ may still change during time t1 to time t2, detection signal $V_g$ may only be generated once. Also, in an alternative implementation, detection signal $V_g$ can be active during time t1 to time t2, in order to keep switch Q on in this period, such that voltage $V_{ILM}$ can remain equal to voltage $V_{ILr}$ until switch Q is turned off at time t2 (not shown in FIG. 4).

During time t2 to time t3, power switch S1 may be turned off and voltage VII, can be positive; that is, resonant current $I_{Lr}$ flows through the parasitic diode of power switch S2 and voltage $V_{ILr}$ begins to decrease linearly. After that, power switch S2 can be turned on under zero voltage switching and then secondary diode D2 is on to transmit energy to the load. In addition, the voltage across the primary winding may be clamped at −NV0; that is, excitation voltage sampling signal $V_{AUX}$ is negative. Then, voltage $V_{ILM}$ can begin to decrease linearly. Feedback signal $V_{FB}$ representing the absolute value of the difference between voltages $V_{ILM}$ and $V_{ILr}$ may initially increase, and then decrease, which is consistent with the waveform of the feedback signal $V_{FB}$ in FIG. 4. At time t3, resonant current $I_{Lr}$ can resonate to be equal to excitation current km, and secondary current $I_2$ is zero.

The high frequency resonance can occur in the transformer because of the parasitic capacitors in the circuit, and then detection circuit 13 can detect that the change rate of excitation voltage sampling signal $V_{AUX}$ changes suddenly. Thus, detection signal $V_g$ may be generated to control switch Q to be turned on, and forcing voltage $V_{ILM}$ to be equal to voltage $V_{ILr}$. After a relatively short period of time, detection signal $V_g$ can be inactive to control switch Q to be turned off. Also, detection signal Vg can also be active during time t3 to time t4 to keep switch Q on such that voltage $V_{ILM}$ can be kept equal to voltage $V_{ILr}$ until switch Q is turned off at time t4 (not shown in FIG. 4).

Figure 5:
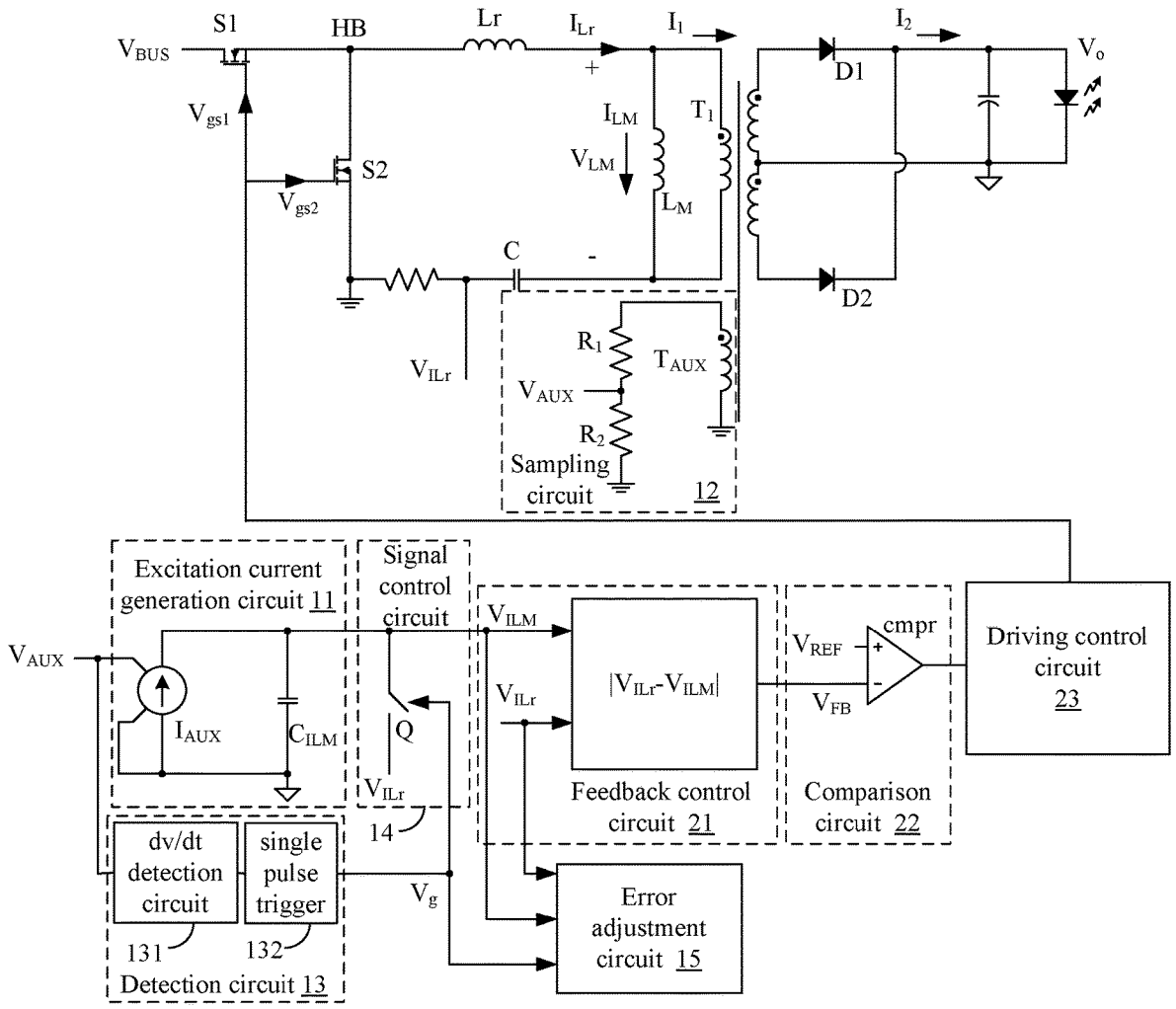
FIG. 5 is a schematic block diagram of a second example primary feedback control circuit of the series resonant converter, in accordance with the embodiments of the present invention.

Referring now to FIG. 5, shown is a schematic block diagram of a second example primary feedback control circuit of the series resonant converter in accordance with the embodiments of the present invention. As compared with the first example primary feedback control circuit in FIG. 3, the difference is that the detection control circuit in FIG. 5 also includes error adjustment circuit 15. In the first example primary feedback control circuit, excitation voltage $V_{LM}$ can be initially sampled to obtain excitation voltage sampling signal $V_{AUX}$, which is converted into current signal $I_{AUX}$, thereby generating voltage $V_{ILM}$ on capacitor $C_{ILM}$. However, it may not be ensured that the conversion coefficient between voltage $V_{ILM}$ and excitation current km is matched well to the conversion coefficient between voltage $V_{ILr}$ and resonant current $I_{Lr}$.

Although the two voltages are forced to be equal to each other when secondary current $I_2$ reaches zero in order to avoid the accumulation of error, the error may still exist in some cases. In this example, error adjustment circuit 15 can receive voltage $V_{ILM}$, voltage $V_{ILr}$, and detection signal $V_g$, and may adjust the control coefficient of the controlled current source to achieve the effect of closed-loop control, such that the two voltages can be equal automatically when secondary current $I_2$ reaches zero. For example, when detection signal $V_g$ is active, adjustment circuit 15 can adjust the control coefficient of the controlled current source in accordance with the difference between voltages $V_{ILM}$ and $V_{ILr}$. In this way, the control can be more accurate.

In addition, error adjustment circuit 15 can function at the beginning of operation to control voltage $V_{ILM}$ to be equal to voltage $V_{ILr}$ when secondary current $I_2$ is zero, and then may be used as a guarantee of the circuit, and then can be ignored thereafter. It should be understood that error adjustment circuit 15 may be achieved in any form of circuit in the art, and may not be limited to analog circuit control or digital circuit control. Any circuit that can adjust the coefficient of the controlled current source by the error between voltages $V_{ILM}$ and $V_{ILr}$ when the detection signal is active may be utilized in particular embodiments.

In one embodiment, a primary feedback control method of a series resonant converter comprising a transformer, can include: (i) sampling an excitation voltage of the transformer to obtain a first voltage representing an excitation current of the transformer; (ii) sampling a resonant current of the series resonant converter to obtain a second voltage; and (iii) controlling on and off states of power switches of the series resonant converter in accordance with the first voltage and the second voltage, where the first voltage is controlled to be equal to the second voltage when a secondary current of the transformer is zero.

Figure 6:
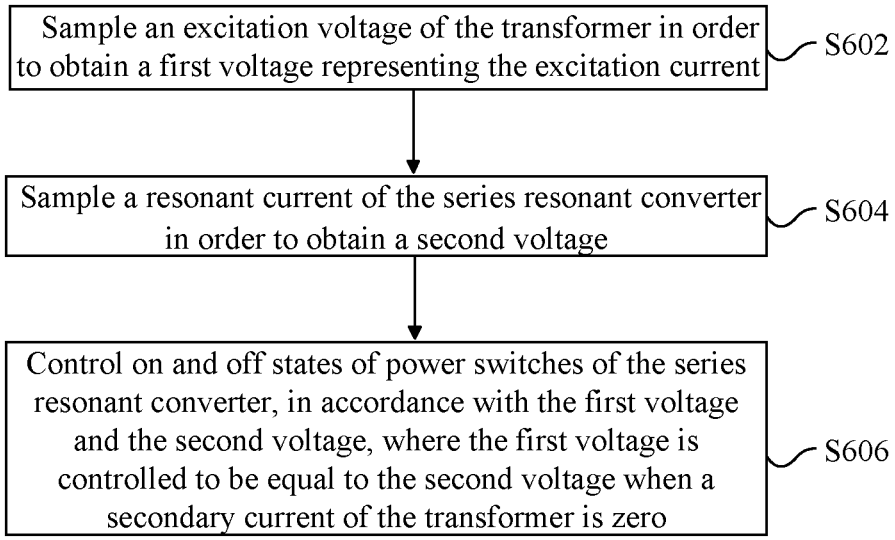
FIG. 6 is a flow diagram of an example primary feedback control method, in accordance with the embodiments of the present invention.

Referring now to FIG. 6, shown is a flow chart of an example primary feedback control method in the embodiments of the present invention. In S602, the excitation voltage of the transformer can be sampled, in order to obtain the first voltage (e.g., $V_{ILM}$) representing the excitation current. The excitation voltage can be sampled by sampling the voltage across the auxiliary winding closely coupled to the secondary winding, or the voltage across the primary winding, to obtain the excitation voltage sampling signal representing the excitation voltage. Then, the excitation voltage sampling signal can be used to control the controlled current source to generate the current to charge or discharge the capacitor, thereby generating voltage $V_{ILM}$ across the capacitor representing the excitation current. In S604, the resonant current of the series resonant converter may be sampled to obtain the second voltage (e.g., $V_{ILr}$). In S606, the on and off states of the power switches can be controlled according to voltages $V_{ILM}$ and $V_{ILr}$, where voltage $V_{ILM}$ may be controlled to be equal to voltage $V_{ILr}$ when the secondary current is zero.

For example, the change of the excitation voltage sampling signal can be detected to generate the detection signal, such that the moment when the secondary current reaches zero can be determined. The detection signal may be active to control voltage $V_{ILM}$ to be equal to voltage $V_{ILr}$ when the secondary current reaches zero. In some embodiments, the detection signal can be set to be active once in each half of the resonant cycle. In other embodiments, the detection signal can, additionally or alternatively, be set to be active during the period when the secondary current is zero.

In addition, controlling voltage $V_{ILM}$ to be equal to voltage $V_{ILr}$ can be realized by the following steps: receiving voltage $V_{ILM}$, voltage $V_{ILr}$, and the detection signal; and adjusting the control coefficient of the controlled current source based on the difference between voltages $V_{ILM}$ and $V_{ILr}$ when the detection signal is active, in order to eliminate the difference. In S606, the feedback signal generated according to the absolute value of the difference between voltages $V_{ILM}$ and $V_{ILr}$ can be compared against the reference signal representing the desired value of the output current, in order to generate the control signal. Also, the driving signals may be generated according to the control signal to control the on and off states of the power switches.

In particular embodiments, by accurately simulating the excitation current of transformer, the switching states of the power switches can be controlled based on the difference between the primary resonant current and the excitation current. In that case, the output current of the series resonant converter can be exactly calculated in any frequency range of the series resonant converter, such that the primary current can be accurately controlled without complex circuitry, and the control circuit may have advantages of a relatively simple structure and low cost.

The embodiments were chosen and described in order to best explain the principles of the invention and its practical applications, to thereby enable others skilled in the art to best utilize the invention and various embodiments with modifications as are suited to particular use(s) contemplated. It is intended that the scope of the invention be defined by the claims appended hereto and their equivalents.

What is claimed is:

1. A primary feedback control circuit of a series resonant converter having a transformer, the control circuit comprising:

a) an excitation current simulation circuit configured to sample an excitation voltage of the transformer, and to generate a first voltage representing an excitation current of the transformer; and b) a feedback control circuit configured to control on and off states of power switches of the series resonant converter in accordance with a feedback signal generated by a feedback generation circuit according to an absolute value of a difference between the first voltage and a second voltage, wherein the second voltage represents a resonant current of the series resonant converter, and wherein the first voltage is controlled to be equal to the second voltage when a secondary current of the transformer is zero.

2. The control circuit of claim 1, wherein the excitation current simulation circuit comprises a detection control circuit configured to detect a change of an excitation voltage sampling signal representing the excitation voltage and generate a detection signal to determine a moment when the secondary current reaches zero, wherein the detection signal is active when the secondary current reaches zero, such that the first voltage is controlled to be equal to the second voltage.

3. The control circuit of claim 2, wherein the detection signal is set to be active once during half of a resonant cycle of the series resonant converter.

4. The control circuit of claim 2, wherein the detection signal is set to be active during a period when the secondary current remains zero.

5. The control circuit of claim 2, wherein the excitation current simulation circuit further comprises a sampling circuit coupled between two terminals of a primary winding of the transformer in order to obtain the excitation voltage sampling signal.

6. The control circuit of claim 2, wherein the excitation current simulation circuit further comprises a sampling circuit comprising an auxiliary winding coupled to a secondary winding of the transformer, and being configured to obtain the excitation voltage sampling signal between two terminals of the auxiliary winding.

7. The control circuit of claim 2, wherein the detection control circuit comprises a detection circuit configured to receive the excitation voltage sampling signal, and generate the detection signal, wherein the detection signal is inactive when the change rate of the excitation voltage sampling signal is constant and the detection signal is active when the change rate of the excitation voltage sampling signal changes.

8. The control circuit of claim 7, wherein the detection control circuit further comprises a signal control circuit configured to receive the first and second voltages, and being controlled by the detection signal to control the first voltage to be equal to the second voltage when the detection signal is active.

9. The control circuit of claim 8, wherein the detection control circuit further comprises an error adjustment circuit configured to receive the first voltage, the second voltage, and the detection signal, and to adjust a conversion coefficient between the first voltage and the excitation current in accordance with a difference between the first voltage and the second voltage when the detection signal is active, in order to eliminate the difference.

10. The control circuit of claim 1, wherein the excitation current simulation circuit comprises an excitation current generation circuit configured to converter an excitation voltage sampling signal representing the excitation voltage into a current signal which charges or discharges a first capacitor to generate the first voltage.

11. The control circuit of claim 10, wherein the excitation current generation circuit comprises:

a) a controlled current source that is controlled by the excitation voltage sampling signal, and being configured to generate a first current representing the excitation current; and b) the first capacitor being connected in parallel with the controlled current source, and being charged or discharged under the control of the first current to generate the first voltage at a first terminal of the first capacitor.

12. The control circuit of claim 1, wherein the feedback control circuit comprises:

a) a comparison circuit configured to compare the feedback signal against a reference signal and to generate a control signal, wherein the reference signal represents an expected output current of the series resonant converter; and b) a driving control circuit configured to control on and off states of the power switches in accordance with the control signal.

13. The series resonant converter, comprising the control circuit of claim 1, and further comprising:

a) the transformer; and b) a resonant inductor and a resonant capacitor coupled in series with a primary winding of the transformer.

14. A primary feedback control method of a series resonant converter comprising a transformer, the method comprising:

a) sampling an excitation voltage of the transformer to obtain a first voltage representing an excitation current of the transformer;

b) sampling a resonant current of the series resonant converter to obtain a second voltage; and c) controlling on and off states of power switches of the series resonant converter in accordance with a feedback signal generated by a feedback generation circuit according to an absolute value of a difference between the first voltage and the second voltage, wherein the first voltage is controlled to be equal to the second voltage when a secondary current of the transformer is zero.

15. The method of claim 14, further comprising:

a) detecting a change of an excitation voltage sampling signal representing the excitation voltage to generate a detection signal; and b) controlling the first voltage to be equal to the second voltage when the detection signal is active, wherein when a moment that the secondary current reaches zero is detected, the detection signal is controlled to be active.

16. The method of claim 15, wherein the detection signal is set to be active once during half of a resonant cycle of the series resonant converter.

17. The method of claim 15, wherein the detection signal is set to be active during a period when the secondary current remains zero.

18. The method of claim 15, further comprising:

a) receiving the first voltage, the second voltage, and the detection signal; and b) adjusting a control coefficient of a controlled current source in accordance with a difference between the first and second voltages when the detection signal is active, in order to eliminate the difference, wherein the controlled current source is controlled by the excitation voltage sampling signal to generate a current, thereby generating the first voltage.

19. The method of claim 14, further comprising:

a) generating a feedback signal according to an absolute value of a difference between the first voltage and the second voltage;

b) comparing the feedback signal against a reference signal representing an expected output current of the series resonant converter to generate a control signal; and c) generating driving signals to control the on and off states of power switches in accordance with the control signal.

* * * * *